FIP7912 XR 4,140,182

United States Patent [19]

Vriend

[11] 4,140,182

[45] Feb. 20, 1979

[54] METHOD OF EXTRACTING OIL

[76] Inventor: Joseph A. Vriend, P.O. Box 505, Squamish, Canada

[21] Appl. No.: 780,715

[22] Filed: Mar. 24, 1977

[51] Int. Cl.[2] ..... E21B 43/20; E21C 41/10

[52] U.S. Cl. ..... 166/263; 166/245; 166/271; 166/274; 166/275

[58] Field of Search ..... 166/263, 266, 267, 52, 166/50, 232, 228, 205, 274, 272, 271, 305, 245, 275, 314, 268; 208/38; 44/7 D

[56] References Cited

U.S. PATENT DOCUMENTS

| | | | |
|---|---|---|---|
| 666,010 | 1/1901 | Helbing | 44/7 D |
| 1,473,644 | 11/1923 | Rodrigo, Sr. | 166/205 |
| 2,630,307 | 3/1953 | Martin | 166/266 |
| 2,919,991 | 1/1960 | Ratje | 208/38 |
| 3,002,915 | 10/1961 | Royder | 208/38 |
| 3,276,518 | 10/1966 | Schlicht et al. | 166/263 |
| 3,837,399 | 9/1974 | Allen et al. | 166/266 |
| 3,845,820 | 11/1974 | Allen et al. | 166/266 |
| 4,022,279 | 5/1977 | Driver | 166/52 |
| 4,022,280 | 5/1977 | Stoddard | 166/272 |
| 4,027,731 | 6/1977 | Smith et al. | 166/267 |

*Primary Examiner*—William Pate, III

*Attorney, Agent, or Firm*—Fulwider, Patton, Rieber, Lee & Utecht

[57] ABSTRACT

A method of extracting oil from an underground bed of an oil-bearing mineral. The method comprises introducing a plurality of conduits into a first, lower part of the bed. Each conduit is spaced from its neighbors and includes a relatively coarse filter at its lower end and contains a relatively fine filter and a lift pump. A first conduit of the plurality of conduits extends to a depth less than the depth of its neighbors. The pressure in the first conduit is reduced. A solvent for the oil is introduced into those conduits at ambient pressure so that the solvent is drawn towards the first conduit and forms a flow path in the bed as it is drawn to the first conduit. The oil-solvent solution is pumped from the first conduit and the space left in the first area after extraction of the oil is filled with water. The conduits are raised to a second, higher part of the bed when all oil has been extracted from the first lower part and the flow direction is recovered by having the first conduit extend to a depth greater than the depth of its neighbors and reducing the vacuum in the neighbors. Oil and solvent are pumped from the neighbors. The conduits are successively raised and the flow direction changed for successive, higher parts of the bed.

10 Claims, 7 Drawing Figures

Fig. 1.
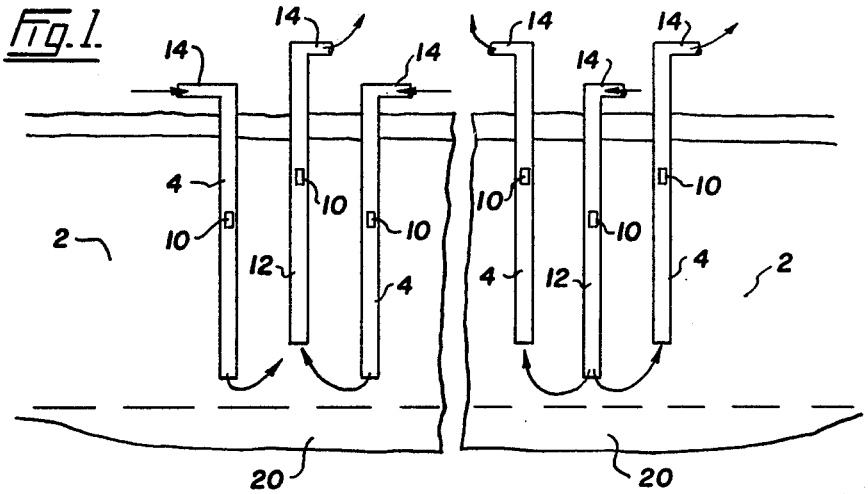
Fig. 2.
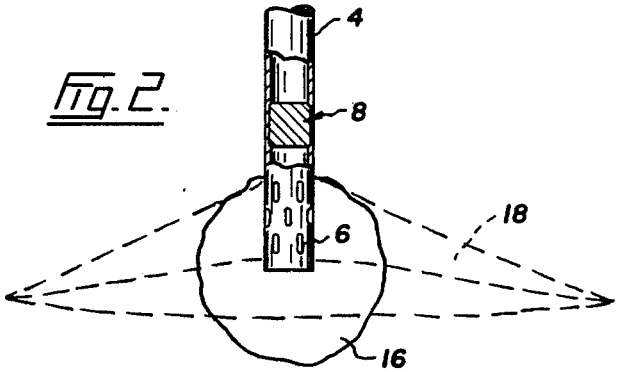
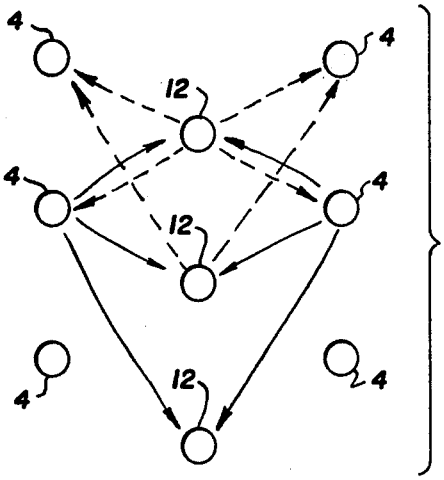
Fig. 3.

Fig. 4.
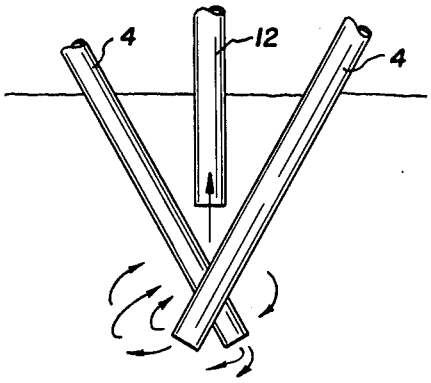
Fig. 5.
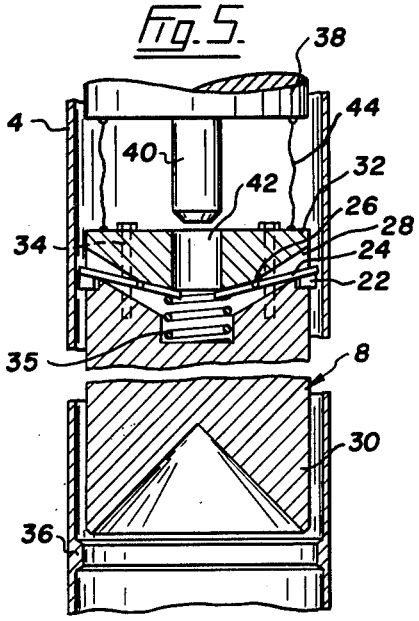
Fig. 6.
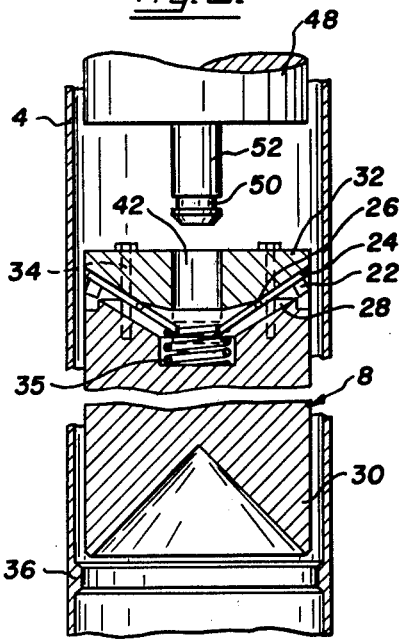
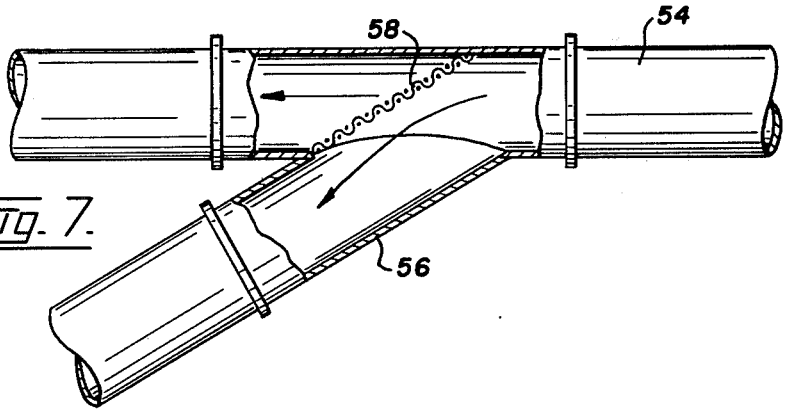
Fig. 7.

METHOD OF EXTRACTING OIL

FIELD OF INVENTION

This invention relates to a method of extracting oil from an underground bed of an oil bearing mineral, in particular from tar sands and oil shales.

DESCRIPTION OF PRIOR ART

The above minerals, represent the world's largest known reserves of petroleum products. However, there are considerable problems in extracting oil from the naturally occurring formations. The formations can be of considerable depth and, even when this is not the case, the extraction of the oil and tar from the occluded sand and other minerals presents considerable difficulties. Processes are known for this extraction but they are extremely cumbersome, extremely expensive, require special and extremely expensive machinery and provide only very low recovery rates, for example, for heavy oil the recovery rate may be as low as 10%.

SUMMARY OF INVENTION

The present invention seeks to provide a process far more economical and far more efficient than the prior art processes. The present invention is a process in which solvent extraction of the oil is used and although such processes are known the present invention provides considerable advantages of the prior art processes, notably in providing a continuous extracting process, refilling the mined area after the process has been carried out and, further, using water to replace the extracted oil.

Accordingly, in a preferred aspect, the present invention is a method of extracting oil from an underground bed of an oil-bearing mineral comprising; introducing a plurality of conduits into a first, lower part of the bed, each conduit spaced from it neighbours and including a relatively coarse filter at its lower end and containing a relatively fine filter and a lift pump, a first conduit of said plurality of conduits extending to a depth less than the depth of its neighbours; reducing the pressure in said first conduit, introducing a solvent for the oil into those conduits at ambient pressure so that the solvent is drawn towards the first conduit and forms a flow path in the bed as it is drawn to said first conduit; pumping the oil-solvent solution from said first conduit; filling the space left in the first area with water after the oil has been extracted; raising the conduits to a second, higher part of the bed when all oil has been extracted from said first lower part and reversing the flow direction by having said first conduit extend to a depth greater than the depth of its neighbours and reducing the vacuum in said neighbours; pumping oil and solvent from said neighbours and successively raising the conduits and changing the flow direction for successive, higher parts of the bed.

The process can desirably include the introduction of a detergent into the area before the water in order to free retained solvents from mineral particles.

If necessary cavities can be formed in the bed by the exploding of charges to form a cavity around the base of one or more of the conduits. This is of particular use in oil shale.

BRIEF DESCRIPTION OF DRAWINGS

The invention is illustrated, merely by way of example, in the accompanying drawings in which:

FIG. 1 illustrates a carrying out of the process of the present invention in successive steps;

FIG. 2 represents a detail of the lower end of a conduit;

FIG. 3 illustrates flow patterns established in a system such as in FIG. 1;

FIG. 4 illustrates a means of imparting a particular flow direction given to the solvents;

FIGS. 5 and 6 illustrate a fine filter useful in the process of the present invention; and FIG. 7 illustrates a simple method of separation of the constituents of the extracted solution.

DESCRIPTRION OF PREFERRED EMBODIMENTS

Referring to the drawings, FIG. 1 illustrates a method of extracting oil from an underground bed of an oil bearing mineral generally indicated at 2. A plurality of conduits 4 are introduced into a first lower part of the bed 2.

Each of the conduits 4 is spaced from its neighbours and includes a relatively coarse filter 6 at its lower end-see FIG. 2- and a relatively fine filter 8 within it. There is a lift pump 10 positioned within each conduit 4. A first conduit 12 extends to a depth less than the depth of its neighbouring conduits 4. Each conduit 4 and 12 has an outlet pipe 14. There is provision in each outlet pipe 14 to permit attaching the outlet 14 to a means of reducing the pressure in the conduit. As illustrated in FIG. 1 the pressure is reduced in the outlet pipe 14-and thus in the first conduit 12-and a solvent for the oil is introduced into the neighbouring conduits 4, that is the conduits at ambient pressure. As a result of the pressure differential between the conduits 4 and the first conduit 12 the solvent is drawn towards the first conduit 12 through the bed 2 from its point of introduction at the lower ends of the conduits 4. The resulting oil-solvent solution is then pumped from the first conduit 12 through its outlet pipe 14. In doing so the substance removed is first subjected to a first coarse filtering by the coarse filter 6 which may be simply wide mesh netting placed over openings in the lower end of the conduit 12. It is then subjected to a relatively fine filtering at the fine filter 8 so that the effluent from the outlet 14 of first conduit 12 is relatively free of mineral particles.

The composition of the solution merging from the first conduit 12 is monitored. This may be carried out by sampling followed by chemical analysis of the sample or, preferably, by a complete computer control of the system including analysis. When the oil content has fallen to a particular level the flow of solvent through the neighbouring conduits 4 is stopped. Water is then introduced through the neighbouring conduits 4 until the water shows in the outlet from the first conduit 12. The conduits 4 and 12 are then raised to a higher level in the bed 2. However, the conduits, 4 are raised to a level higher than the bottom of the first conduit 12 and the pressure is reduced in the neighbouring conduits 4. Solvent is then introduced through the first conduit 12 and establishes a flow path under the influence of reduced pressure, to the neighbouring conduits 4. Oil and solvent are pumped from the neighbouring conduits 4. After the oil has been extracted that level of the bed is filled with water as described above and the conduits raised again. This time the conduits 4 and 12 will resume the relative position that they had when the lower most area of the bed was extracted. It is desirable that the whole process be controlled by computer. That is the switching on and off of the pumps 10 and the reduction in pressure in the conduits be controlled by monitoring the whole process by computer.

It is often desirable to introduce a detergent into the area before the water is fed. By this means solvent that is adhering to mineral particles can be recovered.

It will be appreciated that the constant variation in the flow direction through the conduits 4 and 12 will ensure that the filters, both the coarse filter 6 and the fine filter 8, are back washed at frequent intervals.

FIG. 2 illustrates the formation of an initial cavity 16 by an explosive charge. This is particularly desirable in shale. After the process has been worked for some time the shape of the initial cavity 16 extends to the area 18 as shown in broken lines in FIG. 2 as the mineral structure collapses with the withdrawal of oil. Eventually the cavity will fill with rubble from above, that is the cavity will, in effect, move upwardly.

It is not necessary that there be merely three conduits 4 and 12. FIG. 3 illustrates a system in which a considerable number of conduits are used. How many conduits used will depend purely on the amounts of tar sands under the surface. The arrows in the FIG. 3 illustrates the direction of flow of the oil-solvent solution. Again it is highly desirable that optimum flow patterns be established by computer control based, particularly, on computer analysis of the effluent from the conduits. The computer can control the switching on or off of the pumps 10 and of reduction of pressure in the conduits 4 and 12.

FIG. 4 illustrates an aspect of the invention in which the neighbouring conduits 4 are inclined to each other and spaced on each side of the first conduit 12. The effect of this arrangement is to provide a swirling or vortex flow to the solvents issuing from the conduits 4 which facilitates the extracting action of the solvent. This system has particular application for the extraction of heavy oil since the time of contact of the solvent with the oil tends to be greater. A horizontal, circular flow path can be established to lengthen the dwell time of the solvent in the oil-bearing formation.

Again, in this system, as in all systems according to the present invention, water is fed into the bed 2 after the extraction of oil has been completed and forms a cleaned, water filled area 20 as shown in FIG. 1.

FIG. 5 illustrates a method of installing the fine filter 8 in a conduit 4. The filter 8 is provided with a flexible sealing ring 22 and with locking levers 24 pivotally mounted at 26 in channels 28 formed in filter 8. Filter 8 is formed of a lower section 30 and an upper section 32 bolted together by bolts 34. The channels 28 are between sections 30 and 32. The levers 26 are urged upwardly at their inner ends by a coil spring 35. The filters sit on tapered seats 36 within the conduits 4. To install the filters 8 they are lowered down the conduit 4. A setting member 38 having a central projection 40 to engage in a central opening 42 in upper section 32 is used. This adds weight to the filter 8 to avoid any tendency of the filter 8 to float in oil that may be present in the conduit 4 and maintains the levers 24 out of contact with conduit 4. Setting member 38 is attached to the filter 4 by wires 44. When filter 8 is in position on the seat 36 setting member 38 is withdrawn. The coil spring 35 urges the inner ends of levers 24 upwardly as projection 40 withdraws. The levers 26 thus lock the filter 4 in place on seat 36. The wires 44 are such that they snap as the member 38 is withdrawn without disturbing the position of the filter 8.

To remove the fine filter 10 a removal member 48 is used. Member 48 has a recess 50 in a projecting spindle 52 that engages in opening 42 in the upper section 32 of filter 8. Spindle 52 engages the inner ends of the levers 26 to move the sealing rings 22 off the seats. The whole unit, that is the fine filter 8 and the removal member 48 may then be drawn up the conduit 4 on a wire rope attached to a winch.

The means of separating the constituents of the resulting solution, that is the solvent and the oil are well known in the art and they need not be discussed here. Centrifuging may be used. A relatively simple system that has proved useful is the use of a conduit 54 having a branch conduit 56. A screen 58 is positioned at the junction between the conduits 54 and 56. The mixture of oil and solvent leaves the ground at a relatively high temperature and the process of the present invention will typically be carried out in relatively low temperatures. Most wax type oils form clusters of oil in suspension when the temperature falls. When this happens, the heavy, separated components will pass down the branch conduit 56 and the lighter components will pass through the screen 58 and along the conduit 54.

The solvents used may be recovered in conventional manner, for example by distillation.

Any solvent useful in oil extraction is useful in the process of the present invention. Particularly chlorinated hydrocarbons have proved useful and the fluorinated hydrocarbons appear to have excellent miscibility with oil at a very wide range of temperatures rendering them suitable for the process of the present invention.

It is extremely desirable that the oil produced be gelled or jellied to make it transportable in a solid form rather than using tankers and the like which require the oil in liquid form. The use of polymers, particularly the polyolefins, can be used to gel the oil.

I claim:

1. A method of extracting oil from an underground bed of an oil-bearing mineral comprising:

introducing at least a first conduit into a first, lower part of the bed;

introducing a plurality of discrete, second, conduits in a pattern in which the second conduits are positioned remote from the first conduit;

the first conduit extending to a first depth and the second conduits extending to a substantially uniform second depth, different from said first depth;

reducing the pressure in the first conduit or the second conduits whichever extend to the lesser depth;

introducing a solvent for the oil into the other of said first conduit or second conduits at ambient pressure so that the solvent is drawn towards the said conduit or conduits extending to the lesser depth and forms a flow path in the bed as it is drawn to said conduit or conduits;

pumping the oil-solvent solution from said conduit or conduits extending to the lesser depth;

filling the space left in the first, lower part of the bed with water;

raising the first and second conduits to a second, higher part of the bed when all the oil has been extracted from said first lower part and reversing the flow direction by having said first conduit or second conduits previously extending to a lesser depth of said lower part of said bed extend to a greater depth in said second part of said bed and reducing the pressure in whichever of said first conduit or second conduits extending to the lesser depth;

pumping oil and solvent solution from said first conduit or second conduits extending to said lesser depth and raising the first and second conduits and changing the flow direction for successive, higher parts of the bed.

2. A method as claimed in claim 1 in which the oil bearing mineral is tar sand.

3. A method as claimed in claim 1 including introducing a detergent into the area before the water to free retained solvent from mineral particles.

4. A method as claimed in claim 1 including exploding a charge to form a cavity around the base of one or more of said conduits.

5. A method as claimed in claim 1 including disposing the neighbouring conduits at an angle to the vertical to impart vortex flow to the solvent.

6. A method as claimed in claim 1 in which the fine filter is arranged to be removable from the conduit.

7. A method as claimed in claim 1 including separation by cooling the effluence solution to separate the constituents of the solution, arranging a branch pipe from the outlet conduit and positioning a screen at the junction of the branch and the outlet conduit whereby the lighter components remain in the conduit and the heavier components pass into the downwardly extending branch pipe.

8. A method as claimed in claim 1 in which the oil produced is jellied in order to permit its transport in solid form.

9. The method of claim 1 wherein each of said conduits supports a relatively course filter at tis lower end, a relatively fine filter, and a lift pump.

10. The method of claim 9 wherein a plurality of said first conduits is employed with said plurality of second conduits and individual first conduits are neighbours to individual second conduits.

* * * * *

UNITED STATES PATENT AND TRADEMARK OFFICE

CERTIFICATE OF CORRECTION

PATENT NO. : 4,140,182

DATED : February 20, 1979

INVENTOR(S) : Joseph A. Vriend

It is certified that error appears in the above-identified patent and that said Letters Patent are hereby corrected as shown below:

Claim 1, column 5, line 2, change "extending" to --extend--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*